United States Patent [19]

Michel et al.

[11] 3,938,906

[45] Feb. 17, 1976

[54] SLIDABLE STATOR SEAL

[75] Inventors: Frank Michel, Swarthmore, Pa.; Thomas M. Szewczuk, Claymont, Del.

[73] Assignee: Westinghouse Electric Corporation, Pittsburgh, Pa.

[22] Filed: Oct. 7, 1974

[21] Appl. No.: 513,002

[52] U.S. Cl. ..... 415/139; 415/217; 415/172 A

[51] Int. Cl.[2] ..... F01D 11/00

[58] Field of Search ..... 415/109, 110, 113, 112, 415/136, 137, 138, 139, 216, 217, 218, 219, 170 R, 172 A, 171 R, 173 A

[56] References Cited

UNITED STATES PATENTS

| | | | |
|---|---|---|---|
| 3,117,716 | 1/1964 | Wernicke | 415/136 |
| 3,393,894 | 7/1968 | Redsell | 415/217 |
| 3,519,366 | 7/1970 | Campbell | 415/178 |
| 3,542,483 | 11/1970 | Gagliardi et al. | 415/139 |
| 3,752,598 | 8/1973 | Bowers et al. | 415/173 A |

FOREIGN PATENTS OR APPLICATIONS

| | | | |
|---|---|---|---|
| 165,365 | 12/1956 | Australia | 415/113 |
| 1,020,900 | 2/1966 | United Kingdom | 415/136 |

*Primary Examiner*—Henry F. Raduazo
*Attorney, Agent, or Firm*—F. A. Winans

[57] ABSTRACT

A slidable seal is disposed in one end of each stationary arcuate shroud segment in a gas turbine. The seal is forced by a spring across a gap between adjacent shroud segments, to abut against an end of an adjacent shroud segment. The slidable seal helps control fluid leakage in both the axial and the radial direction.

1 Claim, 5 Drawing Figures

SLIDABLE STATOR SEAL

BACKGROUND OF THE INVENTION

1. Field of the Invention

This invention relates generally to gas turbines, and more particularly, to seals between stator shrouds in the gas turbines.

2. Description of the Prior Art

In axial flow gas turbines, the stator vanes are mounted in a group. They are held in this group by an arcuate shroud member on both their radially inner and their radially outer ends. The shrouds, when adapted to the turbine, form an annular array of support members for the vanes.

A gap exists between adjacent shrouds. The gap permits thermal expansion of the shrouds, and prevents the shrouds from buckling. The gap also, however permits leakage of hot working fluid from the hot working flow path. Turbines have been designed with shrouds that have an overlap between adjacent end portions of the shrouds, or with a tongue and groove seal arrangement. These designs have their limitations, because they allow either a radial or an axial leakage of fluid. A buckling or interference can occur between the shrouds, if the gap is too narrow, or if there is a mismatch or misalignment in the assembly of the shrouds. The present invention helps overcome these objections to the prior art.

SUMMARY OF THE INVENTION

In accordance with one embodiment of the invention, a spring loaded seal is disposed across a gap between adjacent stationary shroud members in a gas turbine engine. The seal extends from one shroud, in a tongue-in-slot manner, and abuts an end of an adjacent shroud. This sealing arrangement prevents radial leakage of hot working fluid from the hot working fluid flow path.

DESCRIPTION OF THE PREFERRED EMBODIMENT

Figure 1:
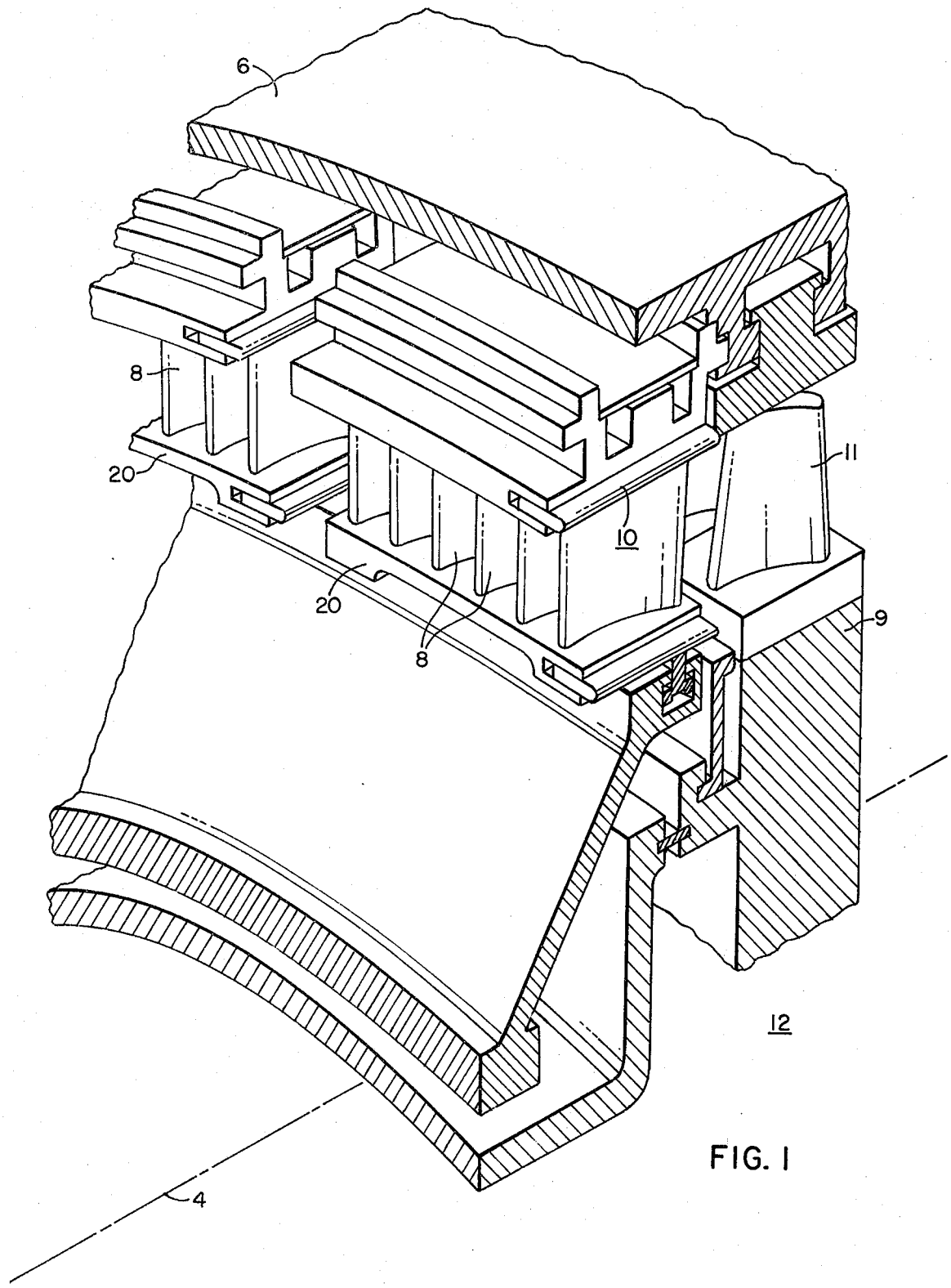
FIG. 1 is a perspective view of a portion of an inlet nozzle of a gas turbine engine, showing a portion of the shroud constructed in accordance with the principles of this invention.

Referring to the drawings, and particularly to FIG. 1, there is shown a portion of an inlet arrangement of an axial flow gas turbine 12 having a shroud and seal arrangement 10. The gas turbine 12 includes a turbine axis 4, an outer cylinder 6, a plurality of stationary inlet vanes 8, and at least one rotor disc 9 with an array of rotating blades 11.

Figure 2:
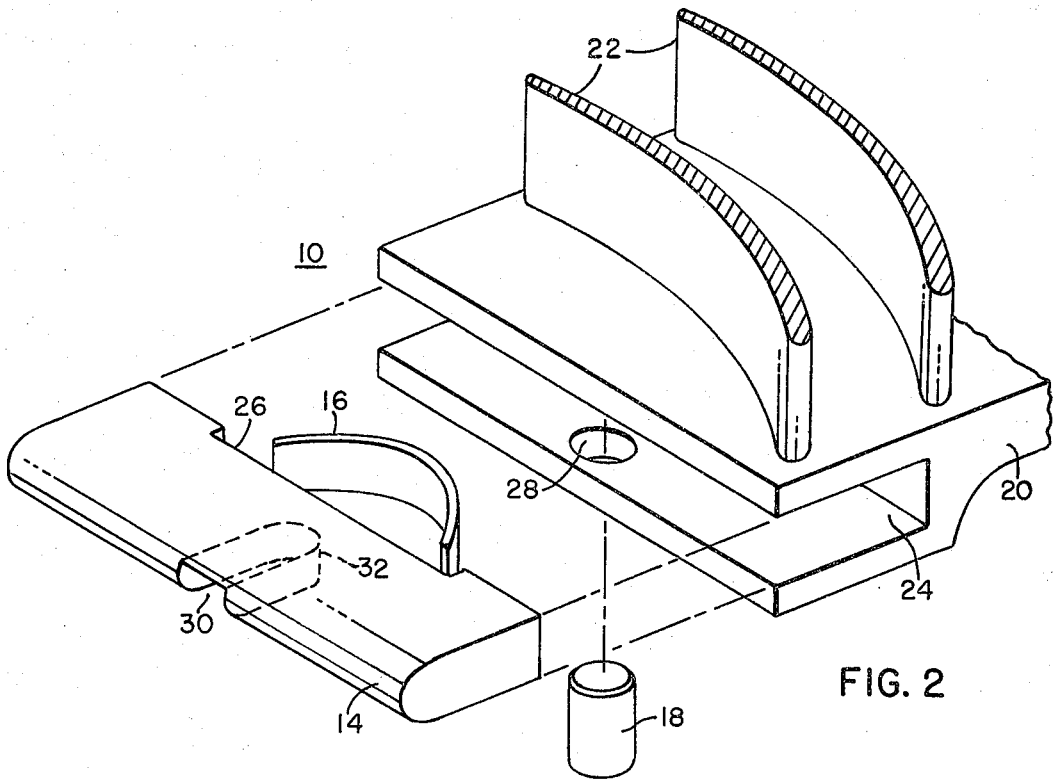
FIG. 2 is a perspective view of a sealing assembly showing a portion of an arcuate shroud.

Shown more clearly in FIG. 2, is a portion of the shroud and seal arrangement 10 of an axial flow gas turbine 12. The seal arrangement 10, as shown in FIG. 2, includes a slidable elongated seal member 14, an expansion clip or spring 16, a retaining pin 18 and a portion of an arcuate circumferentially disposed shroud segment 20. Each shroud segment 20 has a plurality of stator vanes 22 disposed radially thereon.

The shroud segments 20 are disposed in an annular array, within the turbine casing 6. The shroud segments 20 are disposed on both the radially inner and the radially outer ends of the stationary vanes 22.

On one end of each of the circumferentially disposed shroud segments 20, there is an axially disposed groove 24. The groove 24 slidably supports and maintains the elongated seal member 14. Disposed between the seal member 14 and the groove 24 is the spring member 16. A notch 26, in the seal member 14 engages the spring or clip 16 and prevents it from axial dislocation within the groove 24. The spring 16 causes the seal 14 to be pressed outwardly from groove 24, against an end of an adjacent shroud segment.

Figure 3:
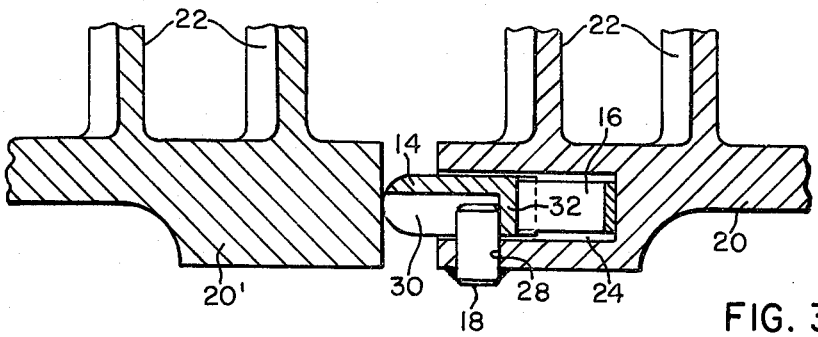
FIG. 3 is an enlarged sectional view, of the seal assembly fully extended.

The retaining pin 18 prevents its respective seal member 14 from extending beyond the supporting walls of the supporting and maintaining groove 24. The retaining pin 18 is disposed through a hole 28 in one wall of the groove 24. The pin 18 cooperatively mates with a circumferentially directed slot 30 in the seal member 14. The slot 30 runs across only a portion of the seal member 14. The pin 18 abuts against a retaining lip 32, as shown in FIGS. 2 and 3, the pin 18 in the slot 30 preventing the seal member 14 from further extension out of the groove 24.

The seal member 14 does not need an engaging slot in an end of an adjacent shroud, to complete the seal. FIG. 3 show the seal member 14 in full extension, abutting a planar end of an adjacent circumferentially disposed shroud member 20'.

Figure 4:
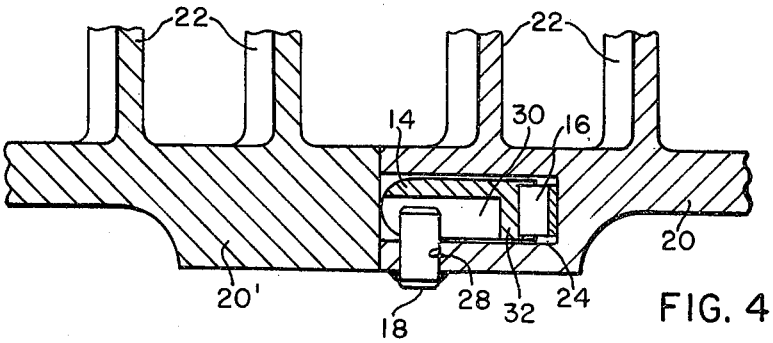
FIG. 4 is an enlarged view of the seal assembly fully compressed.

The seal member 14, may be completely disposed within its supporting groove 24, as shown in FIG. 4. The expansion clip or spring 16, is fully compressed, and no gap exists between the end portions of adjacent shroud segments 20 and 20'. This compressed condition would occur during maximum thermal expansion of the shroud 20 and 20', or during slight thermal expansion and misalignment of the shroud 20 or 20'.

Figure 5:
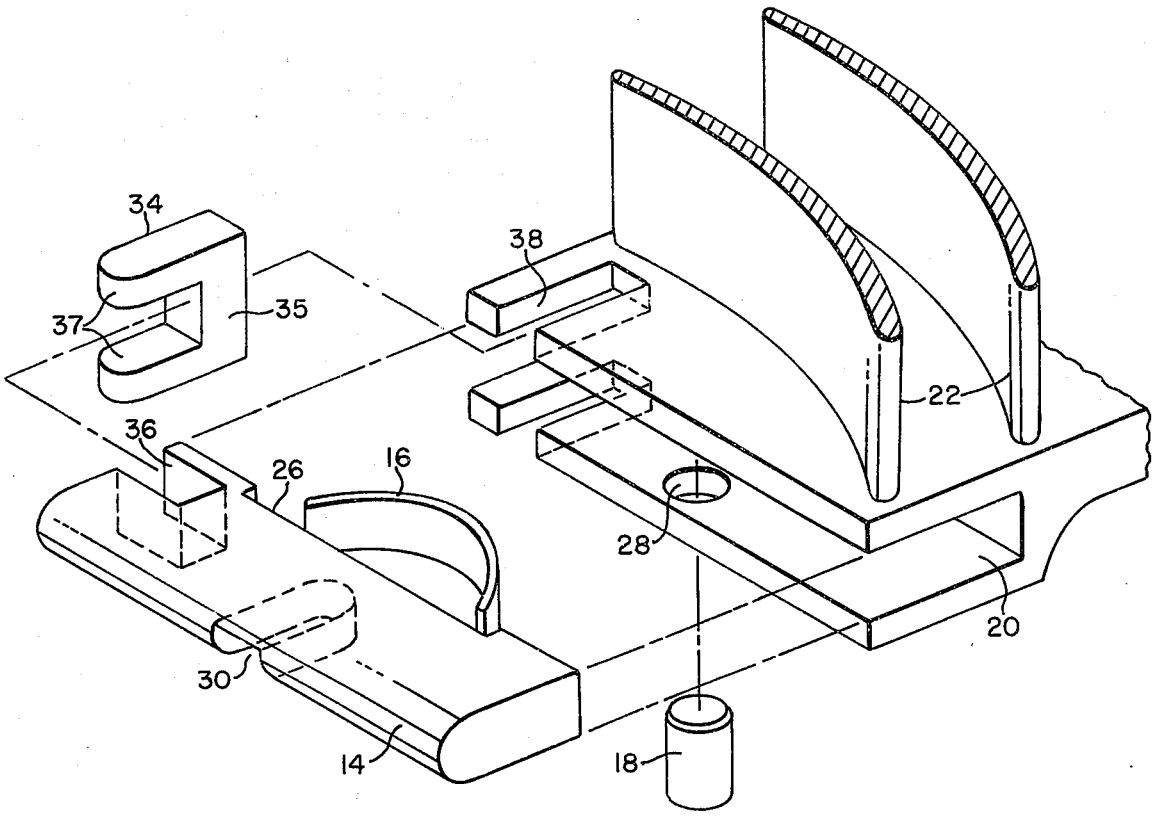
FIG. 5 is a perspective view of an alternative embodiment of the seal assembly, showing the radial fluid seal as well as an axial fluid seal.

An alternative embodiment of the sealing arrangement, is shown in FIG. 5. This embodiment includes a "U" shaped generally parallel legged seal member 34 having generally parallel leg members 37 and a transverse bridge portion 35. A radially directed notch 36 is disposed on one end of the elongated seal member 14, and the bridge portion 35 of the generally parallel legged seal member 34 is disposed therein. A generally radially directed slot 38 is disposed in the walls of the groove 24 in the shroud segment 20, corresponding to the position of the slot 36 in the sliding seal member 14. The bridge portion 35 of the generally parallel legged seal member 34 is mated with the slot 36 in the elongated seal member 14. The generally parallel legs 37 of the generally parallel legged seal member 34 contact the radially inner and outer surfaces of the seal member 14. The legs 37, fit within and cooperate with the slot 38, and provide an axial sealing means for controlling leakage of an axial fluid flow that might flow around the elongated seal member 14, even when the seal member 14 is disposed across the gap between adjacent shroud segments. The retaining pin 18 and the slot 30 in the seal member 14 with which it cooperates, are arranged in the same manner as was the pin 18 and slot 30 arrangement shown in FIGS. 2 and 3.

Since numerous changes may be made in the above-described construction, and different embodiments of the invention may be made without departing from the scope and spirit thereof, it is intended that all subject matter contained in the foregoing description or shown in the accompanying drawings shall be interpreted as illustrative and not in a limiting sense.

What is claimed is:

1. A seal structure for reducing leakage of a fluid between adjacent stationary shroud segments in a turbine comprising, a turbine casing, a blade ring disposed within said casing, an annular array of stationary blades disposed within said blade ring, said blades supported on their radially outer end by a plurality of arcuately formed outer shroud segments and on their inner ends by a plurality of arcuately formed inner shroud segments, said adjacent shroud segments defining gaps therebetween allowing dimensioned changes in said segments due to thermal causes, one end of each of said shroud segment having a slot defined by opposing radially spaced legs, said slot having an opening facing said adjacent segment, a movable seal member mounted in said slot for guided movement towards said adjacent segment, a spring means disposed within said slot for biasing said seal member into abutting sealing engagement with said adjacent segment for sealing said fluid against radial flow across said shroud and radially directed slots in said opposing legs of said segment, said sealing member having a radially enlarged portion received within said radial slots whereby, in conjunction with said spring means, said slot defined by said opposed spaced legs is sealed against axial flow therethrough.

* * * * *